US010640710B2

(12) United States Patent
Hill et al.

(10) Patent No.: US 10,640,710 B2
(45) Date of Patent: May 5, 2020

(54) DISTILLATION UNIT FOR CARBON-BASED FEEDSTOCK PROCESSING SYSTEM

(71) Applicant: Clean Energy Technology Association, Inc., Fairfield, TX (US)

(72) Inventors: Roy W. Hill, Fairfield, TX (US); Jerry Scott Long, Fairfield, TX (US); Tracy Thompson, Fairfield, TX (US)

(73) Assignee: CLEAN ENERGY TECHNOLOGY ASSOCIATION, INC., Houston, TX (US)

( * ) Notice: Subject to any disclaimer, the term of this patent is extended or adjusted under 35 U.S.C. 154(b) by 0 days.

(21) Appl. No.: 16/210,834

(22) Filed: Dec. 5, 2018

(65) Prior Publication Data

US 2019/0106635 A1 Apr. 11, 2019

Related U.S. Application Data

(62) Division of application No. 14/602,767, filed on Jan. 22, 2015, now Pat. No. 10,174,256.

(51) Int. Cl.

| | |
|---|---|
| ***A61L 2/00*** | (2006.01) |
| ***C10B 19/00*** | (2006.01) |
| ***C10B 7/06*** | (2006.01) |
| ***C10B 47/40*** | (2006.01) |
| *C10B 53/02* | (2006.01) |
| *C10B 53/04* | (2006.01) |

(52) U.S. Cl.

CPC ..... *C10B 19/00* (2013.01); *C10B 7/06* (2013.01); *C10B 47/40* (2013.01); *C10B 53/02* (2013.01); *C10B 53/04* (2013.01)

(58) Field of Classification Search

CPC . B01D 3/00; B09B 3/0075; C12F 3/00; F26B 3/00; B03B 9/06; A61L 2/00; A61L 11/00

USPC ..... 422/1, 26, 38, 261, 292, 300, 307; 261/75; 34/549, 559

See application file for complete search history.

(56) References Cited

U.S. PATENT DOCUMENTS

| | | | | |
|---|---|---|---|---|
| 5,660,124 | A * | 8/1997 | Doncer | F26B 17/02 110/227 |
| 6,299,837 | B1 | 10/2001 | Paul et al. | |
| 2009/0007484 | A1 * | 1/2009 | Smith | C10B 47/44 44/606 |

(Continued)

*Primary Examiner* — Monzer R Chorbaji

(74) *Attorney, Agent, or Firm* — Bracewell LLP; Albert B. Kimball; Kevin R. Tamm

(57) ABSTRACT

An apparatus for distillation of feedstock, including a distillation chamber with an inlet for receiving feedstock and an outlet for discharging feedstock, and a plate for supporting the feedstock in the distillation chamber. The plate is positioned parallel to a substantially horizontal plane across a portion of the distillation chamber, and defines a plurality of transverse apertures extending transversely across a substantial portion of the width of the plate. A plurality of heating rods is included for insertion into the apertures of the plate to heat the plate. The apparatus also includes a conveyor enclosed within the distillation chamber and extending longitudinally across the distillation chamber, the conveyor having a plurality of paddles attached thereto that, when driven by the conveyor, move proximate and parallel to the plate to agitate feedstock on the plate, and to drive the feedstock from the inlet to the outlet of the distillation chamber.

7 Claims, 17 Drawing Sheets

(56) References Cited

U.S. PATENT DOCUMENTS

2014/0332724 A1* 11/2014 Tsangaris ..... C01B 3/22
252/373

* cited by examiner

DISTILLATION UNIT FOR CARBON-BASED FEEDSTOCK PROCESSING SYSTEM

RELATED APPLICATIONS

The present application is a divisional application of and claims priority to and the benefit of U.S. application Ser. No. 14/602,767, filed Jan. 22, 2015, the entire disclosure of which is hereby incorporated herein by reference.

BACKGROUND OF THE INVENTION

Field of the Invention

The present invention relates to processing carbon-based feedstock, and in particular to a distillation chamber for use in a distillation process.

Description of the Related Art

Coal is an abundant natural resource capable of exploitation to produce large amounts of energy. Coal in its raw form, however, usually contains undesirable compositions in the form of a number of other chemical compositions or elements. One problem faced in the coal industry is that traditional means of extracting energy from coal have been the subject of concerns, due to possible adverse environmental consequences because of the undesirable compositions usually present in raw coal. For example, historically coal has been burned to create heat, such as to turn water into steam to power a turbine and generate electricity. This process generates large amounts of gaseous emissions containing small amounts of the undesirable compositions which harm the environment. As a result, the use of coal as an energy source can cause tension between the need for an economic way to produce energy on the one hand, and environmental concerns on the other.

During a typical coal processing operation, coal and other carbon-based products are often subjected to distillation processes in order to extract various products therefrom. A typical distillation process involves heating a coal feedstock in the absence of oxygen as the feedstock is moved through a distillation chamber, leading to the creation of different products. In typical distillation processes, many of these products are emitted into the atmosphere and can harm the environment. While some efforts have been made to clean gases prior to their release into the environment, known processes for doing so are inefficient and expensive.

In addition to the above, a distillation process is most effective when the feedstock can be evenly heated, and constantly agitated throughout the process. Accordingly, one shortcoming of many known distillation units is an inability to effectively heat the feedstock, and to agitate the feedstock sufficiently so that the entire mass of the feedstock can be properly heated in an even way.

SUMMARY OF THE INVENTION

Briefly, the present invention provides an apparatus for distillation of feedstock, the apparatus including a substantially enclosed distillation chamber with an inlet for receiving feedstock and an outlet for discharging feedstock, and a plate enclosed within the distillation chamber for supporting the feedstock in the distillation chamber, the plate positioned parallel to a substantially horizontal plane across a portion of the distillation chamber, the plate defining a plurality of transverse apertures extending transversely across a substantial portion of the width of the plate. The apparatus also includes a plurality of heating rods for insertion into the apertures of the plate to heat the plate, and a conveyor enclosed within the distillation chamber and extending longitudinally across the distillation chamber, the conveyor having a plurality of paddles attached thereto that, when driven by the conveyor, move proximate and parallel to the plate to agitate feedstock on the plate, and to drive the feedstock from the inlet to the outlet of the distillation chamber.

In some embodiments, the paddles can be arranged in transverse rows, each row containing three or more paddles separated from one another a predetermined distance so that feedstock can pass between the paddles as the paddles move relative to the plate. In addition, the transverse position of the paddles in adjacent rows can vary so that the feedstock is constantly agitated as the rows of paddles move relative to the plate. Furthermore, each paddle can have a substantially V-shaped cross-section, with a leading edge and two sides that angle outwardly from the leading edge toward the sides of the distillation chamber, and behind the leading edge in a direction opposite the movement of the paddles, so that as the paddles move through the feedstock they separate and move the feedstock in a forward and lateral direction. In certain embodiments, each paddle can be positioned adjacent the plate so that it is agitating the feedstock, and each paddle can be positioned at a negative acute angle relative to the conveyor so that as the paddles move through the feedstock, the feedstock is driven upwardly over the top of the paddles.

In some example embodiments, the cross-sectional shape of the distillation chamber can include a substantially horizontal bottom, two substantially vertical sidewalls, and a top having pitched sides meeting at a curved peak, so that as gasses are produced by the distillation process the shape of the chamber will encourage mixing of the gasses in the top thereof.

Another embodiment of the present invention provides an apparatus for distillation of feedstock that includes a substantially enclosed distillation chamber with an inlet for receiving feedstock and an outlet for discharging feedstock, and a plate enclosed within the distillation chamber for supporting the feedstock in the distillation chamber; the plate positioned parallel to a substantially horizontal plane across a portion of the distillation chamber. In addition, the apparatus includes a conveyor enclosed within the distillation chamber and extending longitudinally across the length of the distillation chamber, the conveyor having a plurality of paddles attached thereto that, when driven by the conveyor, move proximate and parallel to the plate to agitate feedstock on the plate, and to drive the feedstock from the inlet to the outlet of the distillation chamber. The paddles are arranged in transverse rows, each row containing three or more paddles separated from one another a predetermined distance so that feedstock can pass between the paddles as the paddles move relative to the plate, and the transverse position of the paddles in adjacent rows varies so that the feedstock is constantly agitated as the rows of paddles move relative to the plate.

In some alternate embodiments, each paddle can have a substantially V-shaped cross-section, with a leading edge and two sides that angle outwardly from the leading edge toward the sides of the distillation chamber, and behind the leading edge in a direction opposite the movement of the paddles, so that as the paddles move through the feedstock, they separate and move the feedstock in a forward and lateral direction. In addition, each paddle can be positioned adjacent the plate so that it is agitating the feedstock, and each paddle can be positioned at a negative acute angle relative to the conveyor so that as the paddles move through the feedstock, the feedstock is driven upward over the top of the paddles.

In additional embodiments, the plate can define a plurality of transverse apertures extending transversely across a substantial portion of the width of the plate, and a plurality of heating rods for insertion into the apertures of the plate to heat the plate. In addition, the cross-sectional shape of the distillation chamber can include a substantially horizontal bottom, two substantially vertical sidewalls, and a top having pitched sides meeting at a curved peak, so that as gasses are produced by the distillation process the shape of the chamber will encourage mixing of the gasses in the top thereof.

Yet another embodiment of the present invention provides a method of processing feedstock in a distillation device. The method includes the steps of introducing feedstock into a distillation chamber so that the feedstock rests on a substantially horizontal plate in the distillation chamber, inserting rods into apertures in the plate, heating the rods, so that the rods transfer heat to the plate, which in turn transfers heat to the feedstock. The method further includes agitating the feedstock by driving paddles through the feedstock to move the feedstock laterally, as well as forward and vertically upward, and discharging the feedstock from the distillation chamber.

In some embodiments, the method can further include arranging the paddles in rows, the lateral position of the paddles of each row varied from that of the paddles in an adjacent row, to increase the lateral and forward movement of the feedstock as the feedstock is agitated. Other steps that may be part of the method include orienting the paddles so that as they pass through the feedstock, they move the feedstock vertically upward so that the feedstock is constantly circulated from a position adjacent the plate to a position removed from the plate, mixing gases within the distillation chamber prior to venting the gases from the chamber, and electrically heating the rods.

DETAILED DESCRIPTION OF THE PREFERRED EMBODIMENTS

Figure 1:
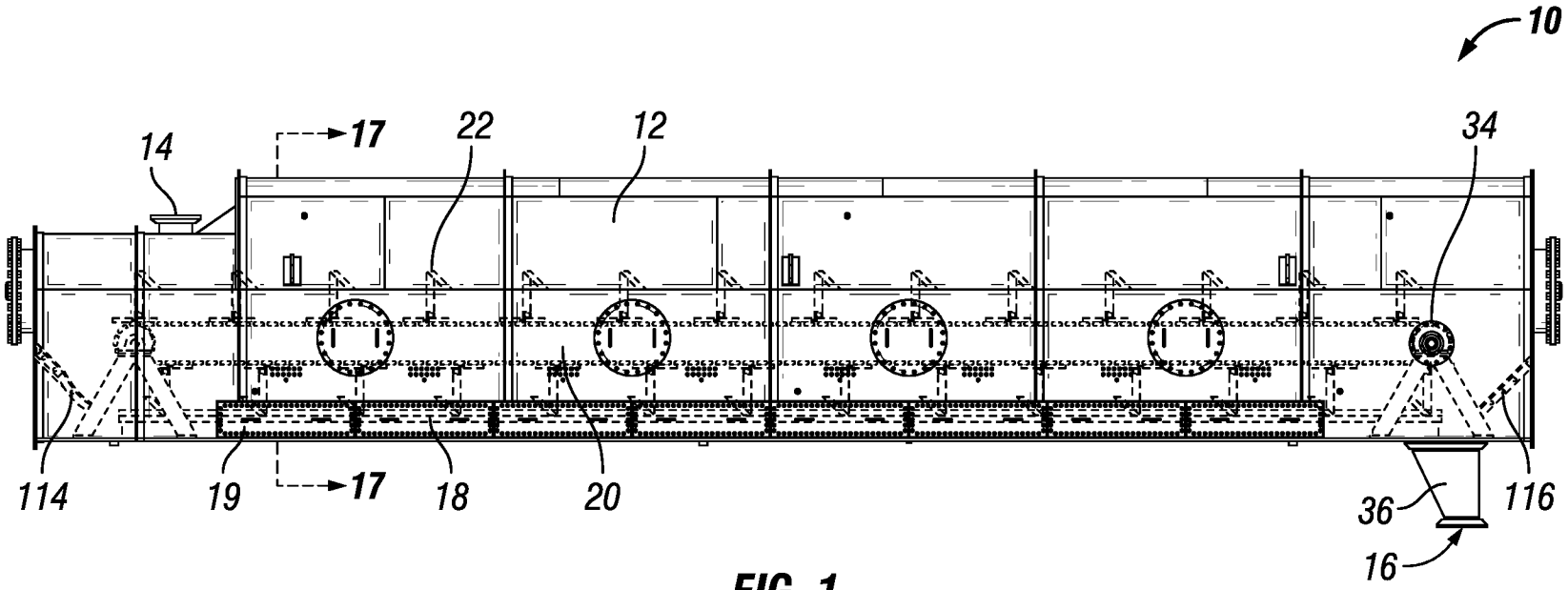
FIG. 1 is side view of a distillation unit according to an embodiment of the present invention.

In FIG. 1, there is depicted a distillation unit 10 according to an embodiment of the present invention. The purpose of the distillation unit is to provide a chamber wherein coal, biomass, or other carbon-based feedstock is subjected to a distillation process. According to such a process, the feedstock is heated in the absence of oxygen as the feedstock is moved through the distillation chamber 13, leading to cracking of the feedstock, and the production of useful products.

The distillation unit 10 depicted in FIG. 1 includes a housing 12 enclosing a distillation chamber 13 (shown in FIG. 2), the housing 12 having an inlet 14 for receiving feedstock 118 (shown in FIG. 17), and an outlet 16 for discharging feedstock 118. The distillation unit 10 further includes, within the distillation chamber 13, a plate 18 to support the feedstock 118 within the distillation chamber 13, an insulation grid assembly 19 with a plate mounting block 21 (shown in FIG. 9), and a conveyor 20 with paddles 22 to assist in moving the feedstock 118 along a surface of the plate 18 from the inlet 14 end of the distillation chamber 13 to the outlet 16 end of the distillation chamber 13.

Figure 2:
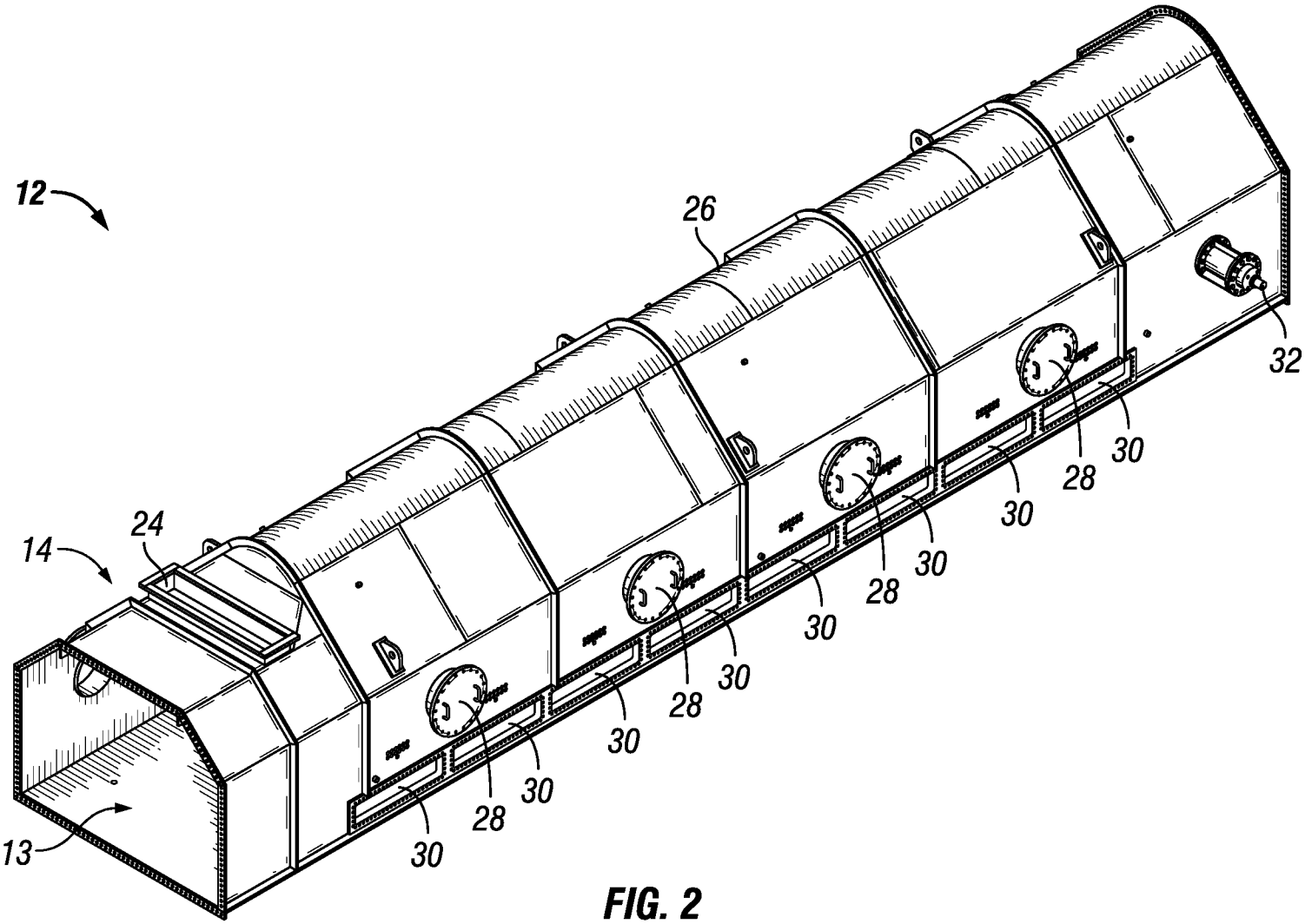
FIG. 2 is a perspective view of the housing of the distillation unit shown in FIG. 1.

Referring to FIG. 2, there is shown a perspective view of the housing 12 surrounding and enclosing the distillation chamber 13. The inlet 14 end of the housing can include an inlet chute 24, configured for attachment to an infeed hopper or meter associated with an infeed hopper (not shown). In one embodiment, the infeed hopper and/meter may be positioned above the inlet chute 24 so that feedstock 118 can be gravity fed into the distillation chamber 13 within the housing 12.

Along a majority of the length of the housing 12, the upper portion 26 of the housing 12 can be domed or peaked. Such a domed or peaked shape induces the mixing of gases produced by the distillation process as the feedstock 118 moves along the lower portion of the distillation chamber 13, which mixing can lead to the formation of beneficial products. The sides of the housing 12 can also include one or more manways 28, designed to provide access to the interior of the housing 12 by an operator. Such access may be necessary to perform tasks such as maintenance or replacement of the equipment within the distillation chamber 13, removal or manual agitation of feedstock 118, etc. Although manways 28 are shown in the drawings, it is to be understood that any appropriate access port or opening can be provided.

In addition, access panels 30 can be provided along the length of the housing 12 to allow access to the plates 18 within the distillation chamber 13, and in particular to heating rods within the plates, as described in detail below. A jackshaft assembly 32 can also be provided on the housing 12 coupled to a gear 34 (shown in FIGS. 1, 12A, and 12B) inside the distillation chamber 13. The gear is configured to turn the conveyor 20 within the distillation chamber 13. Furthermore, the outlet 16 (shown in FIG. 1) of the housing 12 may include a flanged chute 36 capable of carrying the feedstock 118 out of the distillation chamber 13 and into separate equipment, such as a cooler or condensing unit.

Figure 3A:
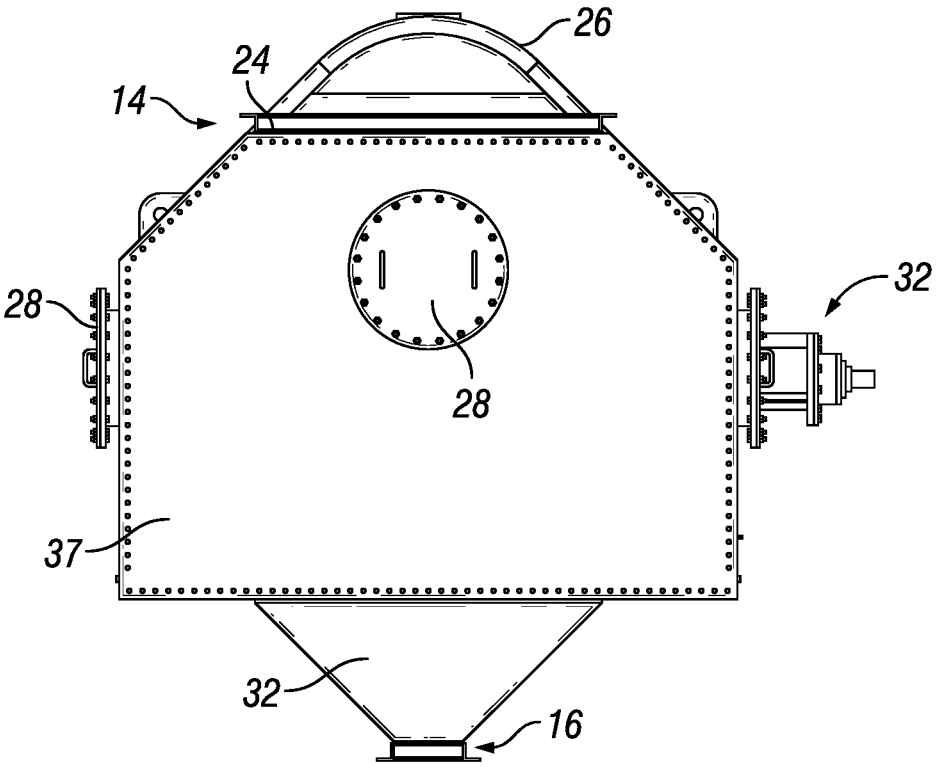
FIG. 3A is a front view of the distillation unit shown in FIG. 1.
Figure 3B:
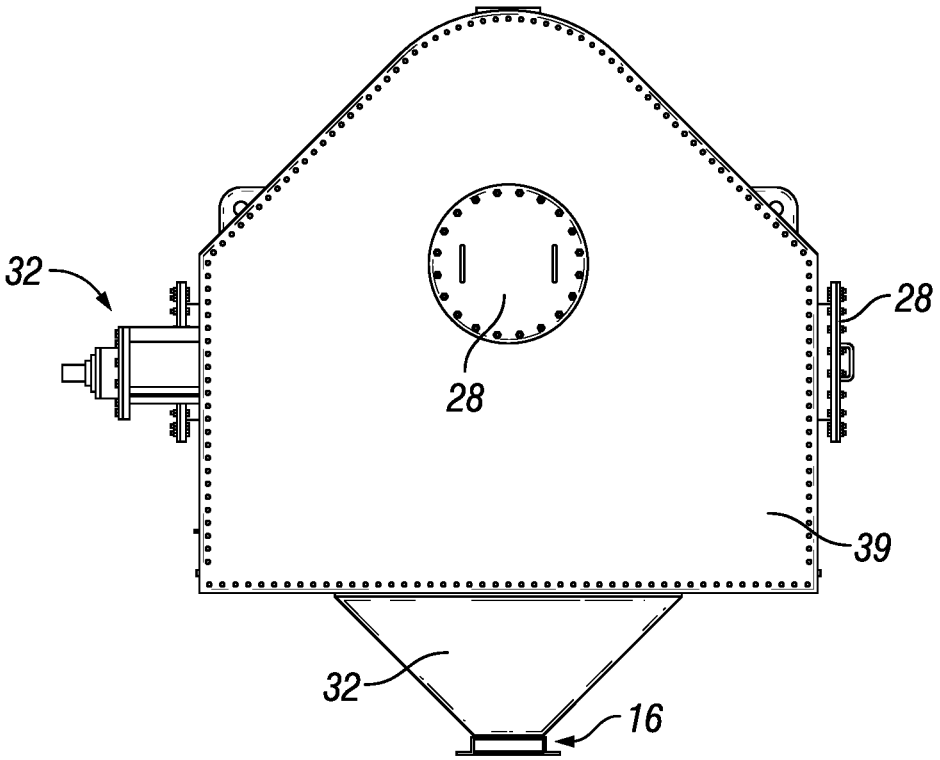
FIG. 3B is a rear view of the distillation unit shown in FIG. 1.

FIGS. 3A and 3B depict front and rear views of the housing 12, respectively. The front end of the housing 12 has a front wall 37 fastened to the sides of the housing 12 and preferably sealed so that oxygen does not enter the distillation chamber 13 within the housing 12. A manway 28 or other opening like those on the sides of the housing 12 may be provided in the front wall 37 to provide access to the distillation chamber 13 through the front wall 37. Similarly, the rear end of the housing has a rear wall 39 fastened to the sides of the housing 12 and preferably sealed so that oxygen does not enter the distillation chamber 13 within the housing 12. A manway 28 or other opening like those on the sides of the housing 12 and the front wall 37 may be provided in the rear wall 39 to provide access to the distillation chamber 13 through the rear wall 39.

Figure 4:
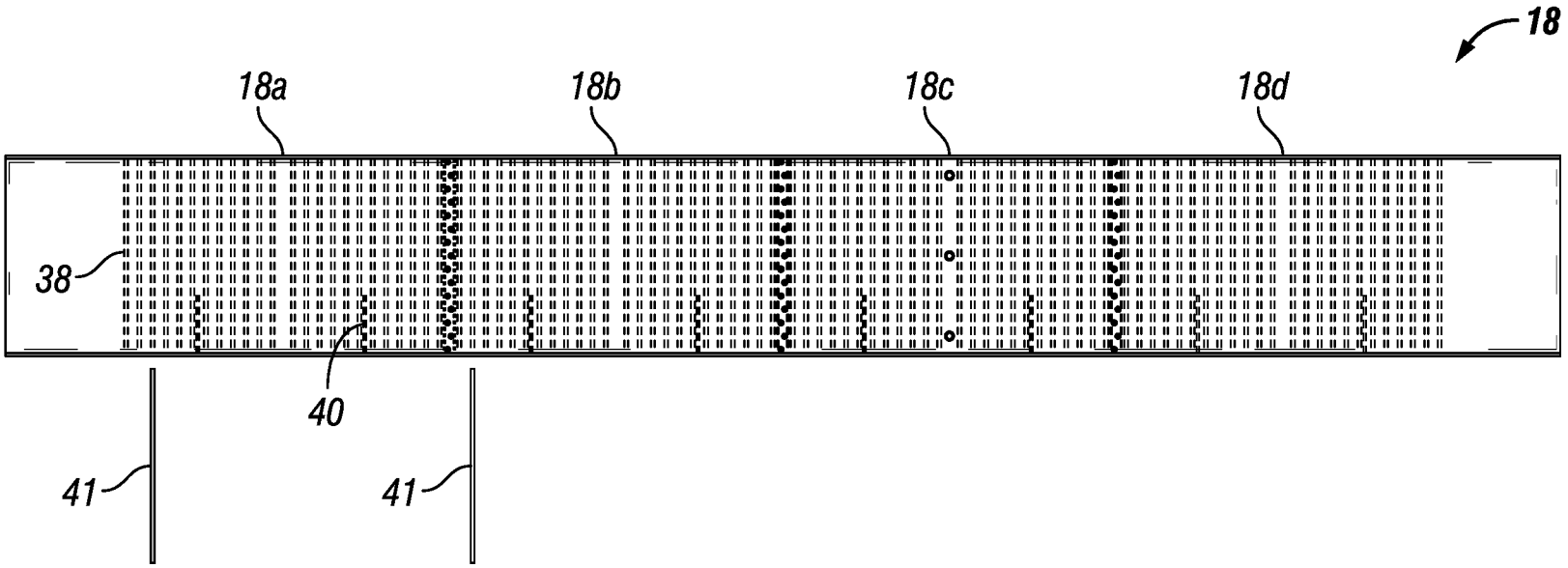
FIG. 4 is a top view of a plate of a distillation unit according to an embodiment of the present invention.

FIG. 4 is a top view of the plate 18 used to support the feedstock 118 within the distillation chamber 13. In some embodiments, the plate may be divided into multiple plate sections 18*a*, 18*b*, 18*c*, 18*d*. For example, in the embodiment of FIG. 4, the plate 18 is divided into first plate section 18*a*, second plate section 18*b*, third plate section 18*c*, and fourth plate section 18*d*. When fully installed in the housing 12, the plate 18 extends the majority of the length of the housing 12. Also shown in FIG. 4 are transverse heating apertures 38 and thermocouples 40. The heating apertures 38 are configured to accept elongate heating rods 41 that heat the plates, which in turn heat the feedstock 118. The thermocouples 40 may be provided to measure the temperature of the plate 18 so the temperature can be maintained within predetermined ranges.

Figure 5A:
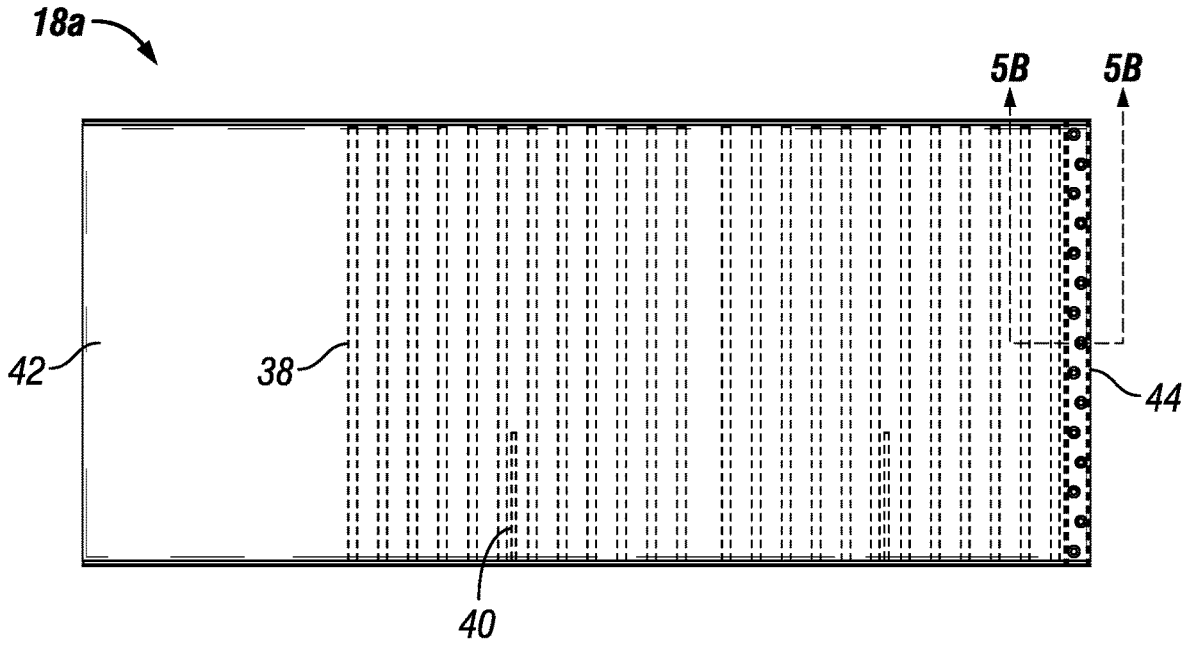
FIG. 5A is a top view of a section of the plate shown in FIG. 4.
Figure 5B:
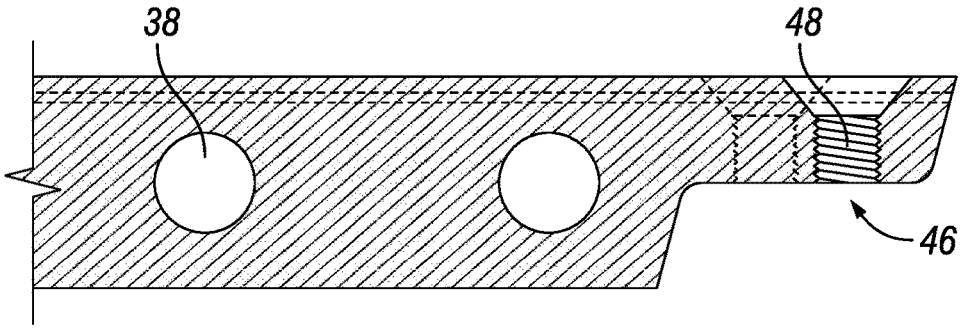
FIG. 5B is a side cross-sectional view of the plate shown in FIG. 5A, taken along line 5B-5B.

First plate section 18*a*, as best shown in FIGS. 5A and 5B, is designed for placement at the inlet end of the distillation chamber 13. Thus, as feedstock 118 is fed into the distillation chamber 13, it drops through the inlet chute 24 (shown in FIG. 2), and lands on first plate section 18*a*. As the feedstock 118 is driven along first plate section 18*a*, as discussed in detail below, the surface of the first plate section 18*a* is heated by the heating rods 41 in the transverse heating apertures 38. The feedstock 118 may first contact the first plate section 18*a* adjacent a first end 42 thereof, and from there it will be driven towards a second end 44 of the first plate section 18*a*. The second end 44 of the first plate section 18*a* may have a lip 46, as shown in FIG. 5B, with apertures 48 for receiving fasteners (not shown). The lip 46 corresponds to a corresponding lip 50 (shown in FIG. 6C) of the second plate section 18*b*, and the fasteners may pass through the lips 46, 50 of both sections in order to fixedly attach the plate sections to one another. In FIG. 5B, the apertures 48 are shown to be threaded, and are configured to accept threaded bolts. In practice, however, the apertures 48 may be unthreaded, and any appropriate type of fastener may be used. In addition, the apertures 44 are shown in FIGS. 5A and 5B to be staggered across the width of the first plate section 18*a*. Such a staggered pattern is advantageous because it helps to reduce stresses in the fasteners and plates. Such a staggered pattern, however, is not necessary, and any appropriate configuration of apertures 44 can be used.

Figure 6A:
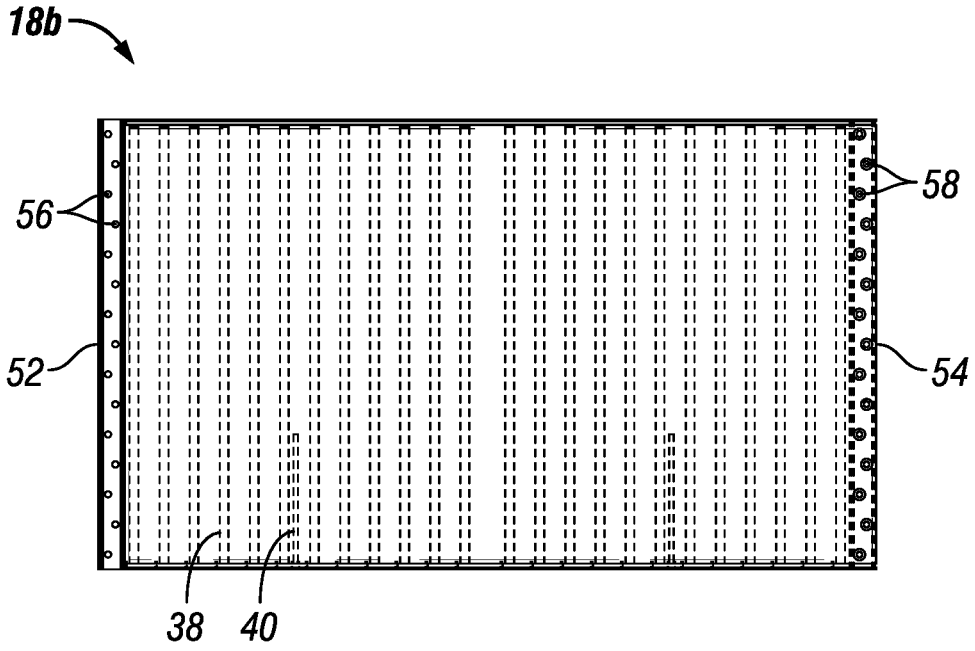
FIG. 6A is a top view of a section of the plate shown in FIG. 4.
Figure 6B:
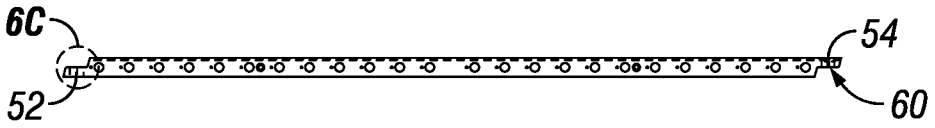
FIG. 6B is a side view of the section of plate shown in FIG. 6A.
Figure 6C:
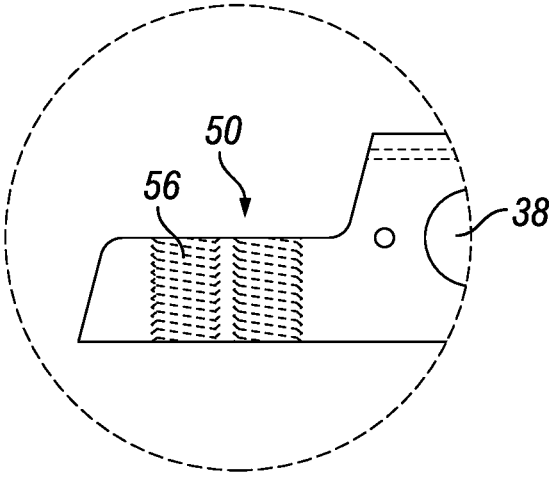
FIG. 6C is an enlarged side view of the section of the plate of FIG. 6B identified by area 6C.

Second plate section 18*b* is shown in FIGS. 6A-6C, and includes first end 52 and second end 54. Each of first end 52 and second end 54 of the second plate section 18*b* contain apertures 56, 58 for fasteners that can attach the second plate section 18*b* to adjacent plate sections. Apertures 56 pass through the lip 50 of the first end 52 which, as discussed above, corresponds and aligns with the lip 46 of the first plate section 18*a*, so that the first and second plate sections 18*a*, 18*b* can be attached by fasteners passing through apertures 48 of the first plate section 18*a* and apertures 50 of the second plate section 18*b*.

The second end 54 of the second plate section 18*b* has a lip 60 similar to lip 46 of the first plate section 18*a*. Apertures pass through lip 60, and correspond to apertures 68 in lip 62 of the third plate section 18*c* (shown in FIGS. 7A and 7B). Although apertures 56, 58 are shown in a staggered configuration across the width of lips 50, 60, respectively, it is to be understood that the apertures 56, 58 could be arranged in any appropriate configuration, including in a straight line. Furthermore, although apertures 56 are shown to be threaded, they could alternatively be unthreaded. In addition, similar to the other plate sections, the second plate section 18*b* includes transverse heating apertures 38 for accepting elongate heating rods 41 (shown in FIG. 4), and thermocouples 40.

Figure 7A:
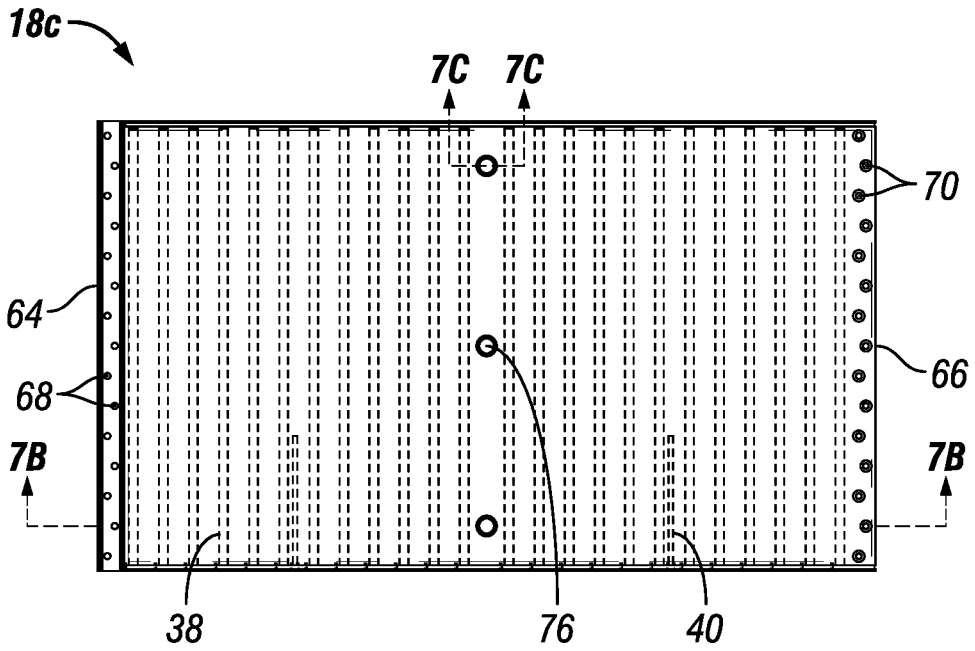
FIG. 7A is a top view of a section of the plate shown in FIG. 4.
Figure 7B:
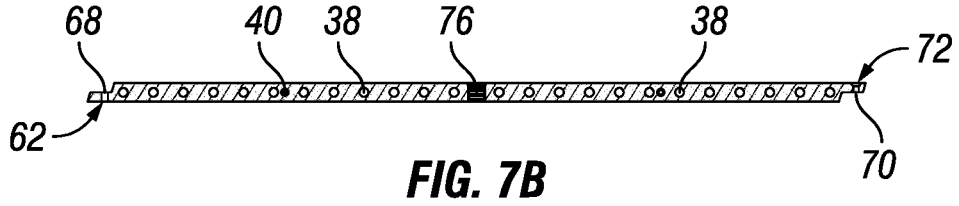
FIG. 7B is a side cross-sectional view of the section of plate shown in FIG. 7A, taken along line 7B-7B.
Figure 7C:
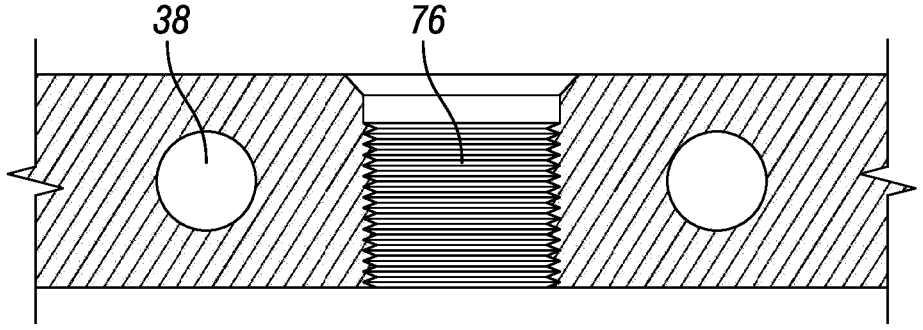
FIG. 7C is an enlarged side cross-sectional view of part of the section of the plate shown in FIG. 7A, taken along line 7C-7C.

The third plate section 18*c* is shown in FIGS. 7A-7C, and includes first end 64 and second end 66. Each of first end 64 and second end 66 of the third plate section 18*c* contain apertures 68, 70 for fasteners that can attach the third plate section 18*c* to adjacent plate sections. Apertures 68 pass through the lip 62 of the first end 64 which corresponds and aligns with the lip 60 of the second plate section 18*b*, so that the second and third plate sections 18*b*, 18*c* can be attached by fasteners passing through apertures 54 of the second plate section 18*b* and corresponding apertures in the lip 62 of the third plate section 18*c*.

The second end 66 of the third plate section 18*c* has a lip 72 similar to lip 60 of the second plate section 18*b*. Apertures pass through lip 72 and into lip 74 of the fourth plate section 18*d* (shown in FIGS. 8A and 8B). Although apertures 68, 70 are shown in a staggered configuration across the width of lips 62, 72, respectively, it is to be understood that the apertures 68, 70 could be arranged in any appropriate configuration, including in a straight line. In addition, similar to the other plate sections, the third plate section 18*c* includes transverse heating apertures 38 for accepting elongate heating rods 41 (shown in FIG. 4), and thermocouples 40. The third plate section 18*c* may also include mounting apertures 76. The mounting apertures 76 may be used to accept fasteners for attaching the plate 18 to other components in the distillation chamber 13, such as, for example, the insulation grid assembly 19, described in detail below. Thus, the plate 18 may be anchored in the distillation chamber 13 so that it stays in one place relative to the housing 12 while the feedstock 118 passes over the plate 18.

Figure 8A:
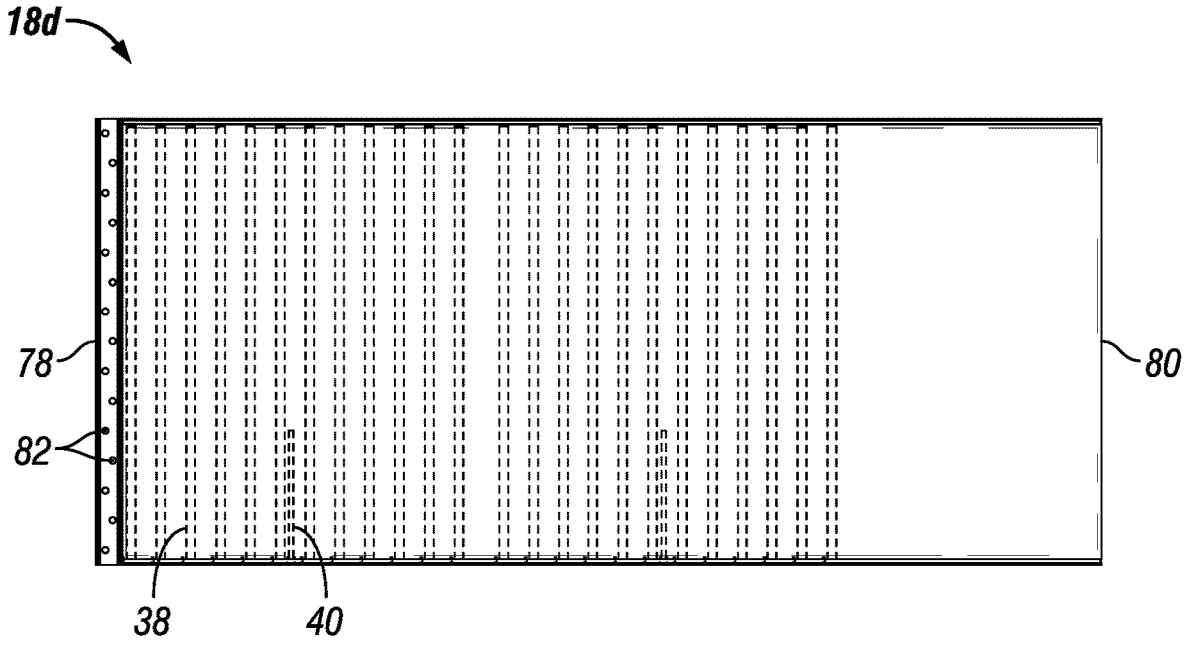
FIG. 8A is a top view of a section of the plate shown in FIG. 4.
Figure 8B:
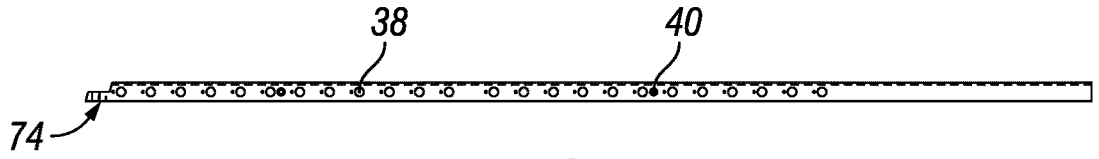
FIG. 8B is a side view of the section of plate shown in FIG. 8A.

The fourth plate section 18*d* is shown in detail in FIGS. 8A and 8B, and includes first end 78 and second end 80. First end 78 of the fourth plate section 18*d* contain apertures 82 for fasteners that can attach the fourth plate section 18*d* to the third plate section 18*c*. Apertures 82 pass through the lip 70 of the second end 66 of the third plate section 18*c*, which corresponds and aligns with the lip 74 of the fourth plate section 18*d*, so that the third and fourth plate sections 18*c*, 18*d* can be attached by fasteners passing through apertures 70 of the third plate section 18*c* and the corresponding apertures 82 in the lip 74 of the fourth plate section 18*d*.

The second end 80 of the fourth plate section 18*d* terminates the plate 18 at the discharge end of the distillation chamber 13 in the housing 12. When the feedstock 118 falls off the second end 80 of the fourth plate section 18*d*, it then leaves the distillation chamber 13 via outlet chute 36. Although apertures 82 are shown in a staggered configuration across the width of the lip 74, it is to be understood that the apertures 68, 70 could be arranged in any appropriate configuration, including in a straight line. In addition, similar to the other plate sections, the fourth plate section 18*d* includes transverse heating apertures 38 for accepting elongate heating rods 41 (shown in FIG. 4), and thermocouples 40.

Figure 9:
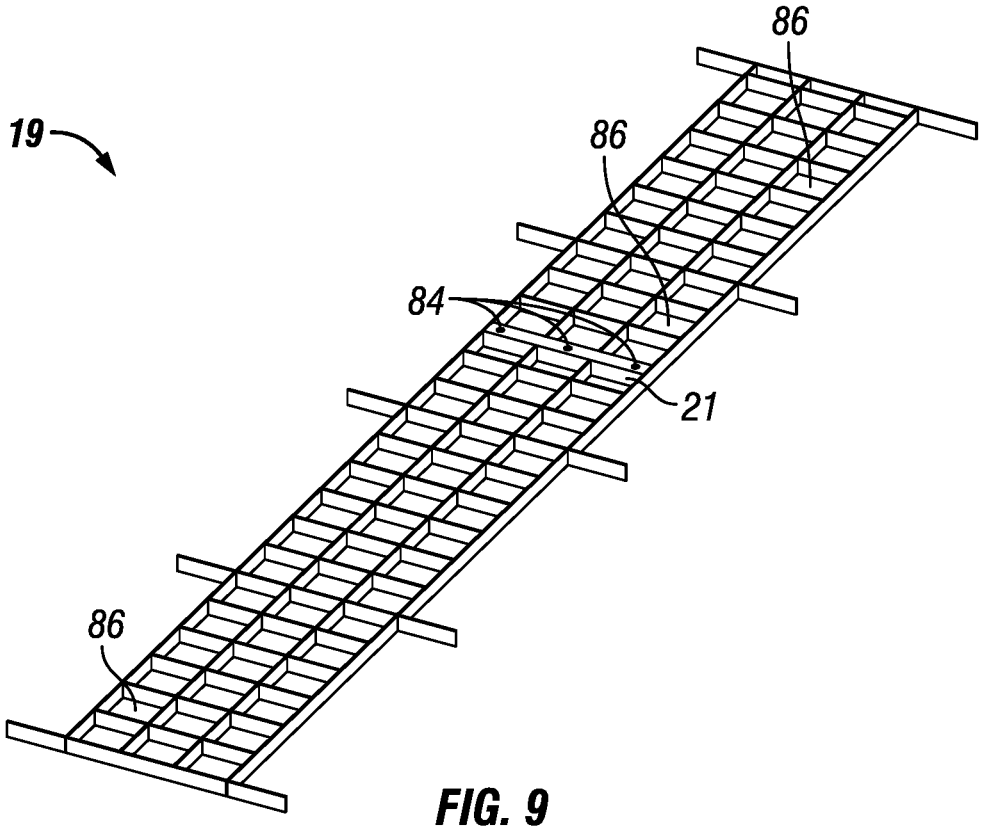
FIG. 9 is a perspective view of an insulation grid assembly, according to an embodiment of the present invention.

Referring to FIG. 9, there is shown the insulation grid assembly 19 with the plate mounting block 21, according to an embodiment of the invention. The insulation grid assembly 19 is positioned in a bottom portion of the distillation chamber 13, as shown in FIG. 1, and the plate mounting block 21 serves as an attachment point for the plate 18. Apertures 84 in the plate mounting block 21 correspond to apertures 76 in the third plate section 18*c*. Fasteners can be passed through apertures 84 of the plate mounting block 21 and apertures 76 of the third plate section 18*c* to attach the third plate section 18*c* to the plate mounting block 21, thereby limiting or eliminating movement of the plate 18 relative to the plate mounting block 21.

The insulation grid assembly 19 also includes voids 86 which, when the insulation grid assembly 19 and plate 18 are mounted in the distillation chamber 13, separate the plate 18 from the bottom of the distillation chamber 13. In some embodiments, the voids 86 may be filled with insulation.

Figure 10:
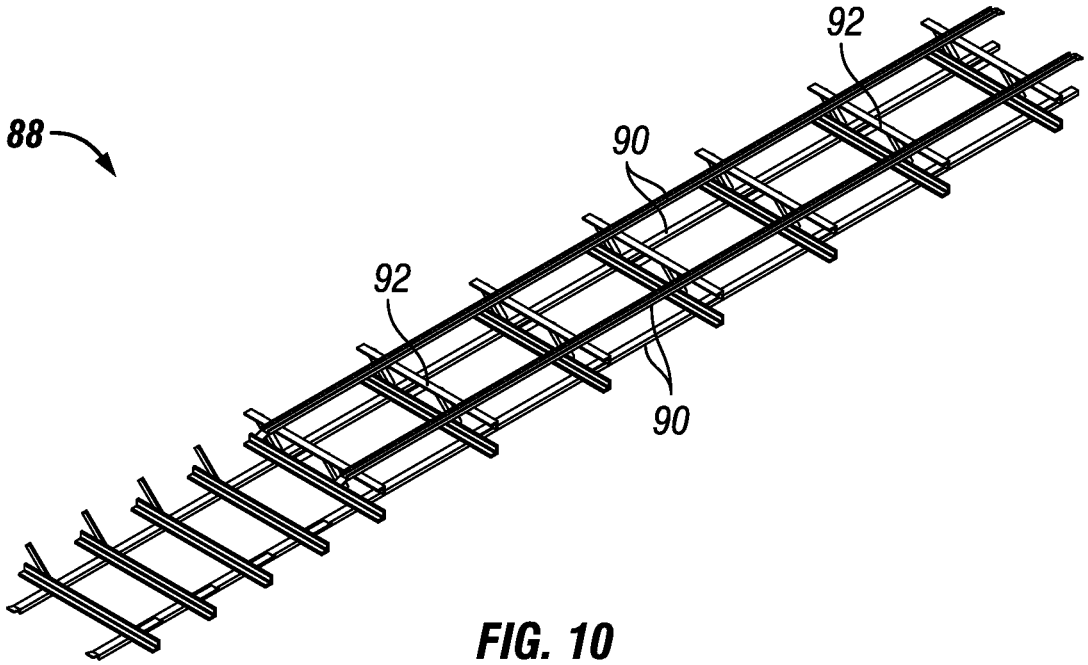
FIG. 10 is a perspective view of a conveyor support, according to an embodiment of the present invention.
Figure 11A:
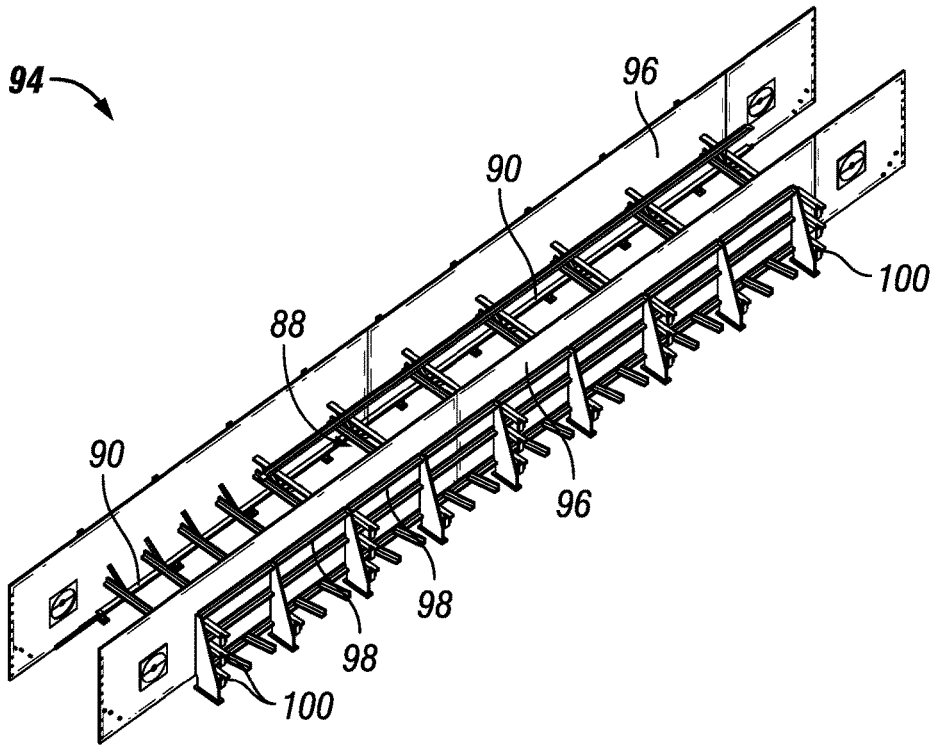
FIG. 11A is a perspective view of a bulkhead assembly according to an embodiment of the present invention.
Figure 11B:
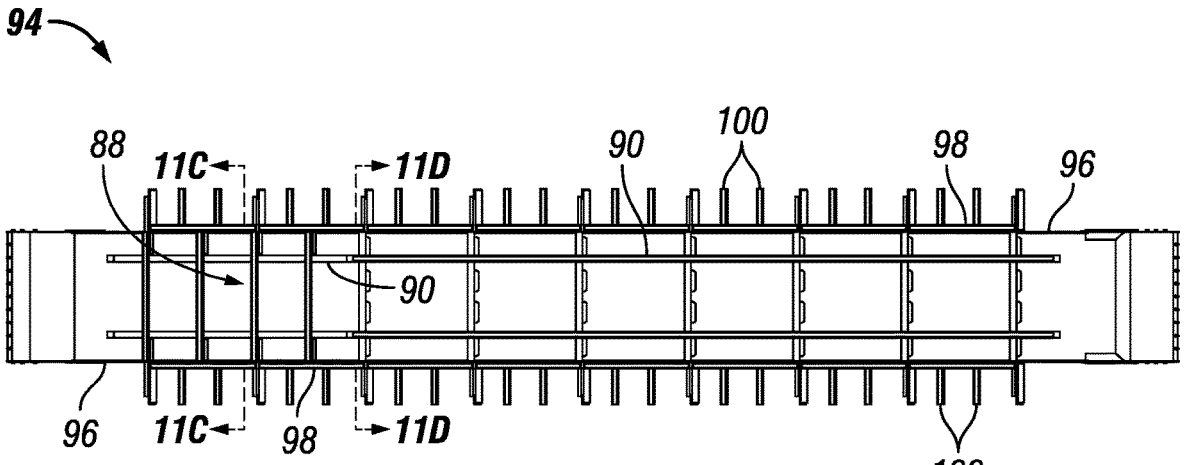
FIG. 11B is a top view of the bulkhead assembly shown in FIG. 11A.
Figure 11C:
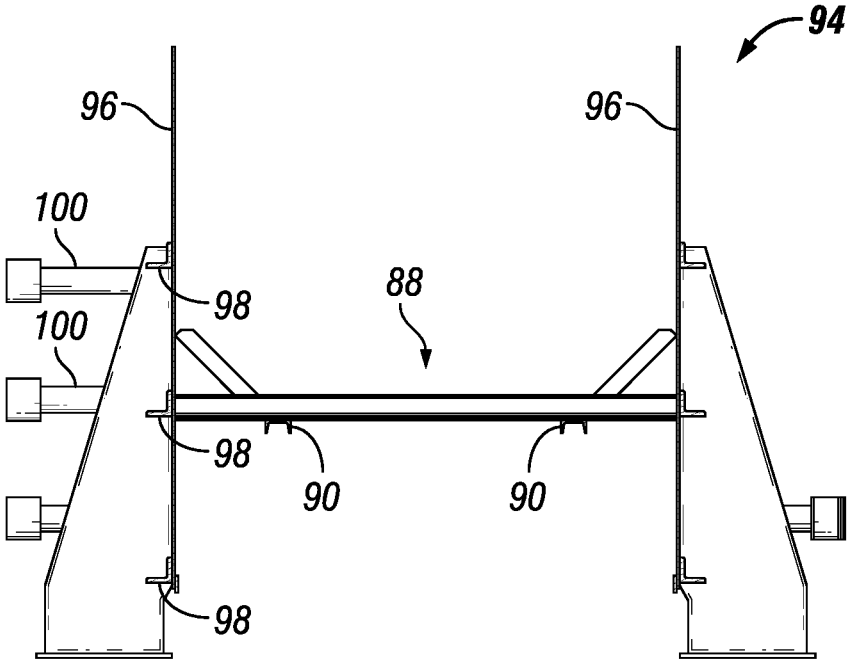
FIG. 11C is a cross-sectional view of the bulkhead assembly of FIG. 11B, taken along line 11C-11C of FIG. 11B.
Figure 11D:
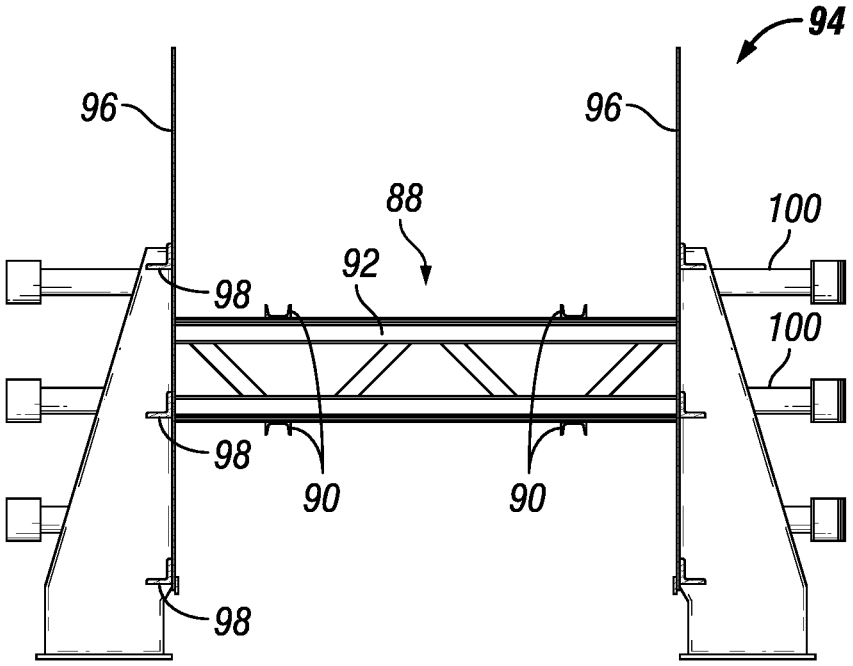
FIG. 11D is a cross-sectional view of the bulkhead assembly of FIG. 11B, taken along line 11D-11D of FIG. 11B.
Figure 13A:
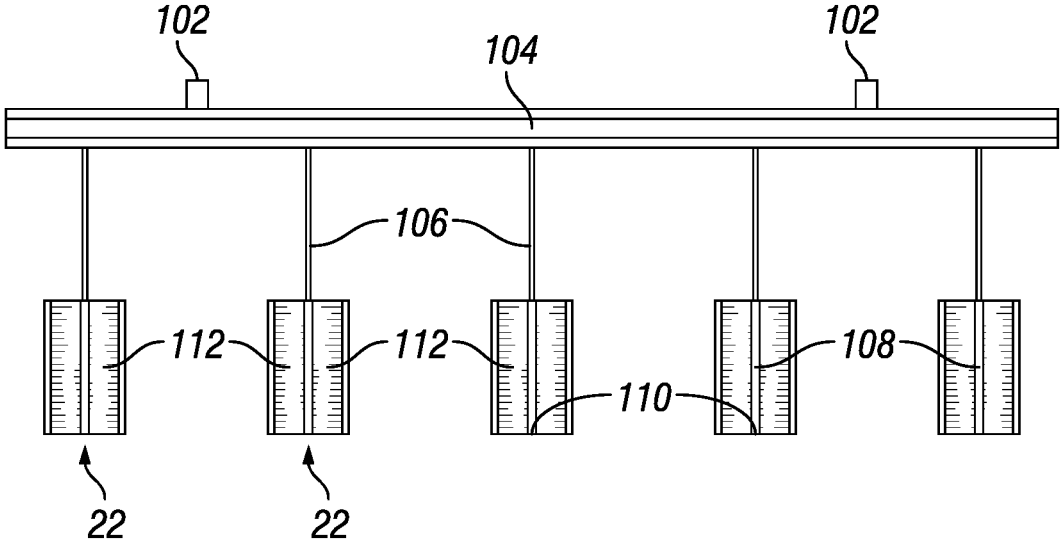
FIG. 13A is a front view of paddles attached to the conveyor according to an embodiment of the present invention.
Figure 13B:
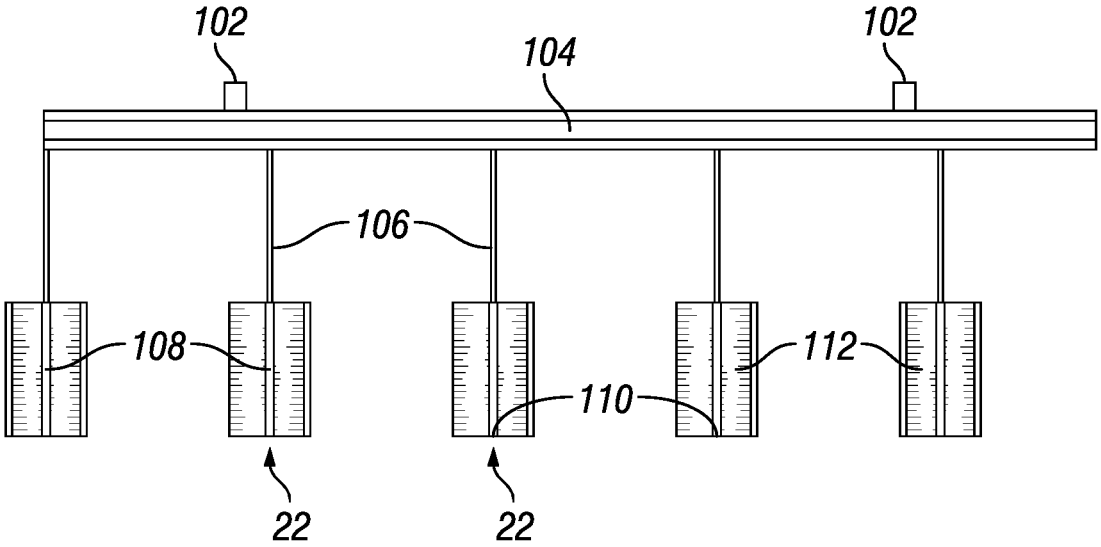
FIG. 13B is a front view of paddles similar to those shown in FIG. 13A, but arranged in a different configuration.

In FIG. 10, there is shown a conveyor support 88 for supporting the conveyor 20 (shown in FIGS. 1, 13A, and 13B). The conveyor support 88 includes chain guides 90 on upper and lower sides thereof, for guiding the chains associated with the conveyor 20. Between the upper and lower chain guides 90 are transverse support members 92, which provide rigidity to the conveyor 20 and support the weight of the portion of the conveyor 20 located above the conveyor support 88.

The conveyor support 88 is positioned between, and is a part of, the bulkhead assembly 94 shown in FIGS. 11A-11D. The bulkhead assembly 94 provides a rigid support structure for many of the components in the distillation chamber 13, and includes sidewalls 96 and an outer frame structure with longitudinal supports 98, for providing strength and rigidity to the sidewalls 96 in a longitudinal plane in the distillation chamber 13, and outwardly extending side supports 100 that extend from the bulkhead sidewalls 96 to the sidewalls of the housing 12.

The side supports 100 of the bulkhead assembly 94 help to fix the components in the distillation chamber 13 during operation of the distillation unit 10, including fixing the position of the conveyor support 88. To accomplish this, the conveyor support 88 can be fixedly attached to the sidewalls 96 and/or longitudinal supports 98 of the bulkhead assembly 94.

Figure 12A:
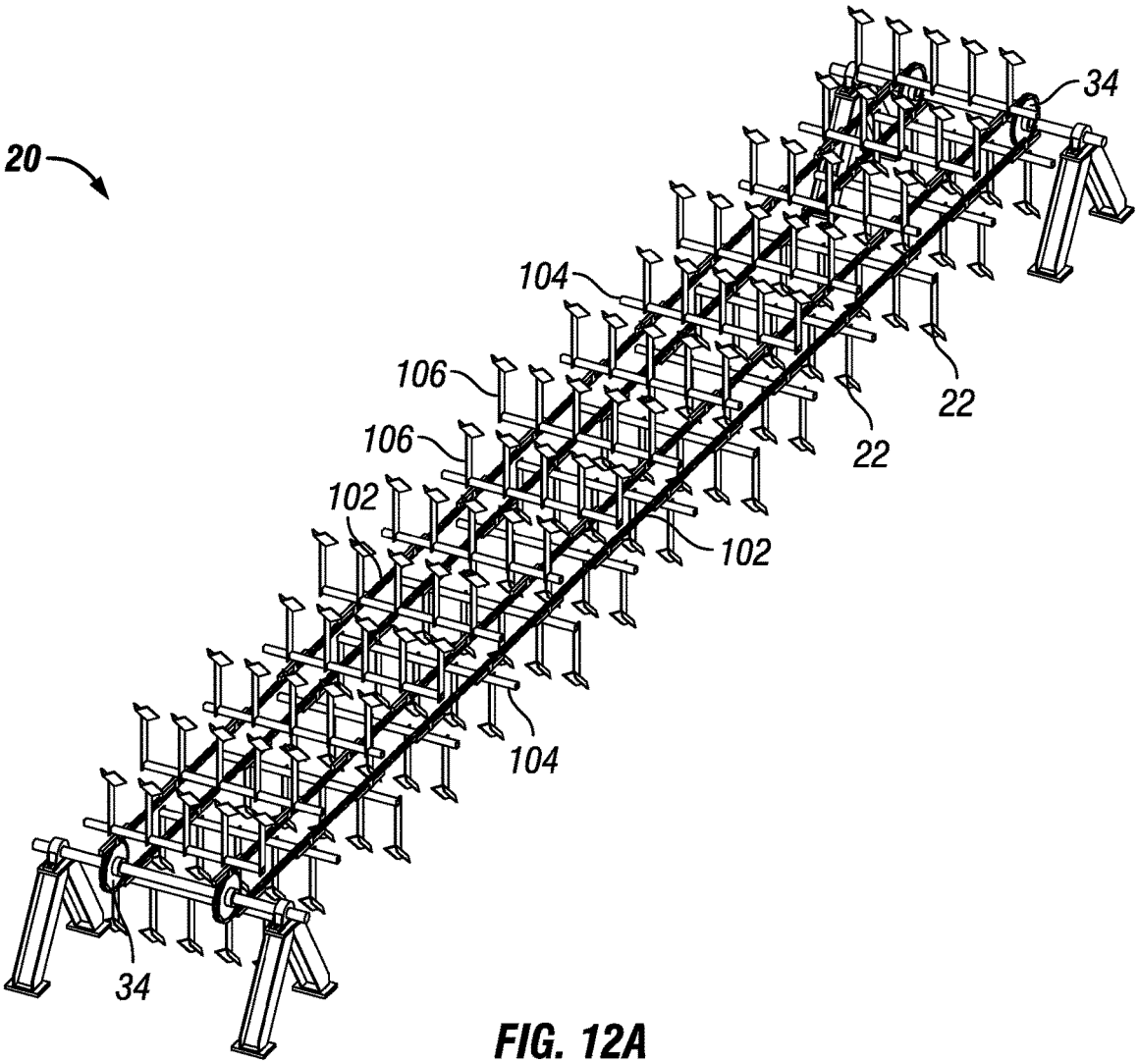
FIG. 12A is a perspective view of a conveyor, according to an embodiment of the present invention.
Figure 12B:
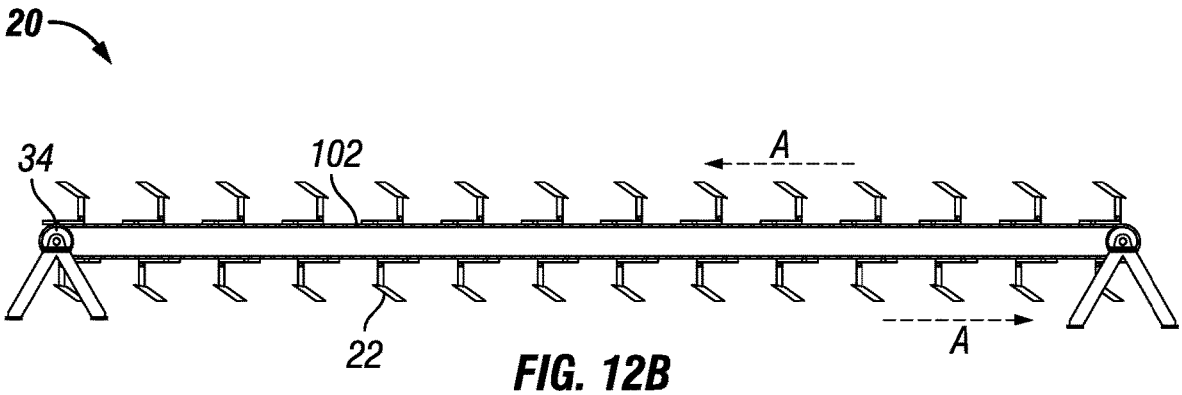
FIG. 12B is a side view of the conveyor shown in FIG. 12A.

Referring to FIGS. 12A and 12B, there is shown a conveyor 20 according to an embodiment of the invention. The conveyor 20 includes conveyor chains 102 that rotate around gears 34, and that span substantially the entire length of the distillation chamber 13 from the inlet 14 to the outlet 16 (see also FIG. 1). The conveyor chains 102 carry crossbars 104 with extension members 106 having paddles 22 attached thereto. Each crossbar 104 includes a plurality of extension members 106 and paddles 22. For example, in the embodiment shown, five extension members 106 with paddles 22 are attached to each crossbar 104, although it is to be understood that any appropriate number of extension members 106 and paddles 22 may be used. As indicated by the arrows A in FIG. 12B, the conveyor 20 moves the paddles 22 in a counterclockwise direction, so that, as shown in FIG. 1, the paddles 22 on the bottom of the conveyor 20 move from the inlet 14 toward the outlet 16. Also, as shown in FIG. 1, the paddles on the bottom of the conveyor 20 are positioned adjacent the plate 18, on which sits the feedstock 118, so that as the paddles 22 move toward the outlet 16, they move through the feedstock 118.

Figure 13C:
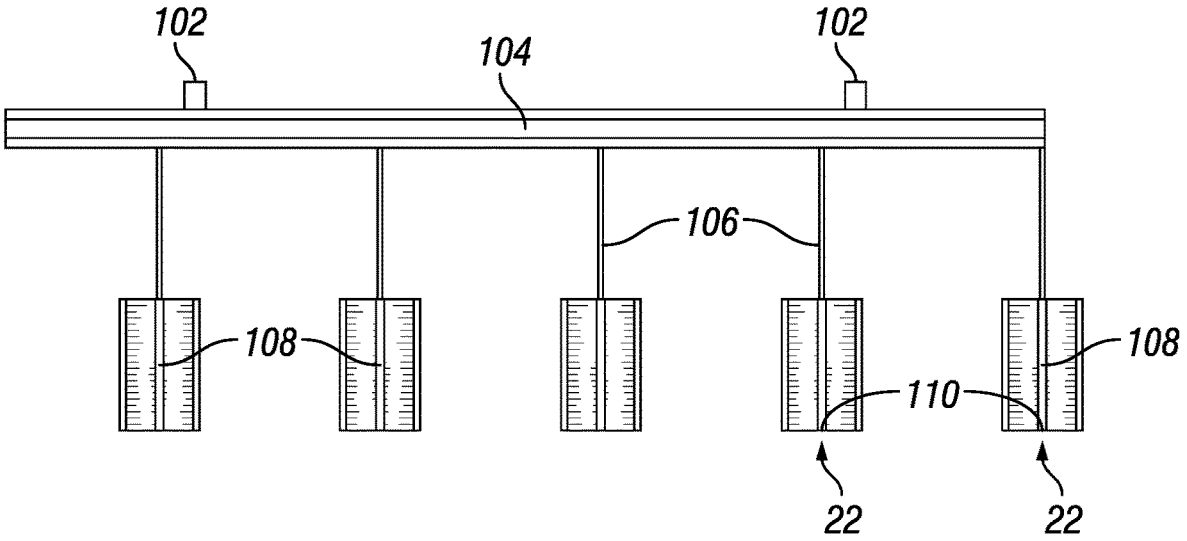
FIG. 13C is a front view of paddles similar to those shown in FIGS. 13A and 13B, but arranged in a different configuration.

Referring back to FIG. 12A, the transverse position of the of extension members 106 and paddles 22 of adjacent crossbars 104 is shown to be staggered, so that the paddles 22 of adjacent rows are not longitudinally aligned. In fact, in the particular embodiment shown, there are three different paddles configurations, illustrated in detail in FIGS. 13A-13C. In 13A, the group of five extension members 106 and paddles 22 is positioned in a centered arrangement, with the extension members 106 and paddles 22 spaced and equal distance from one another, and the extension members 106 and paddles 22 on the ends each spaced equidistant from the ends of the crossbar 104. Alternatively, in FIG. 13B, the extension members 106 and paddles 22 are shifted to the left, so that the left-most extension member 106 is attached to the left end of the crossbar 104. Similarly, in FIG. 13C, the extension member 106 and paddles 22 are shifted to the right, so that the right-most extension member 106 is attached to the right end of the crossbar 104. These three configurations are placed adjacent one another, as shown in FIG. 12A, with the pattern repeating.

One advantage to staggering the paddles 22 in this manner is that as the paddles move through the feedstock 118 in the distillation chamber 13, each paddle 22 separates and moves the feedstock 118 that it contacts both forward and laterally. The staggering of the paddles 22 ensures that as subsequent rows of paddles 22 pass through the feedstock 118, the feedstock 118 is continually moved forward and also laterally, thereby increasing movement of the feedstock 118 within the distillation chamber 13. Although the paddles 22 and extension members 106 have been shown herein to be arranged in particular configurations, it is to be understood that these configurations are exemplary only, and many different configurations could be used without departing from the spirit and scope of the invention.

Figure 14:
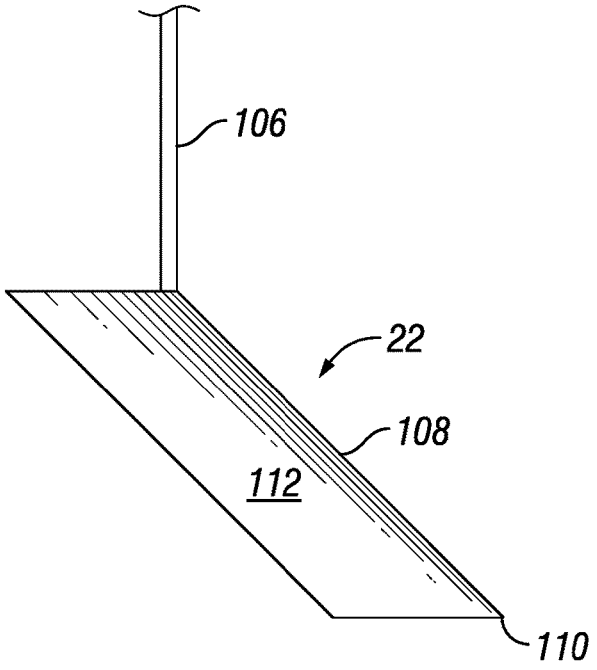
FIG. 14 is a side view of a paddle according to an embodiment of the present invention.

FIG. 14 shows the shape of an individual paddle 22, according to an embodiment of the invention. The paddle 22 includes a leading edge 108 that slopes forward to a point 110. Each side 112 of the paddle 22 slopes outward and away from the leading edge 108. One advantage of this paddle shape is that, as the paddle 22 moves through feedstock 118, the forward slope of the leading edge 108 of the paddle 22 pushes the feedstock 118 upward from the point 10 toward the extension member 106. Thus, feedstock 118 located at a lower end of the paddle 22 is circulated upward. At the same time, the outward slope of each side 112 of the paddle pushes the feedstock 118 laterally outward. Thus, the staggering of the multiple paddles 22, combined with the shape of each individual paddle 22, combine to thoroughly agitate and mix the feedstock 118 as the paddles 22 move through the feedstock 118.

Figure 15:
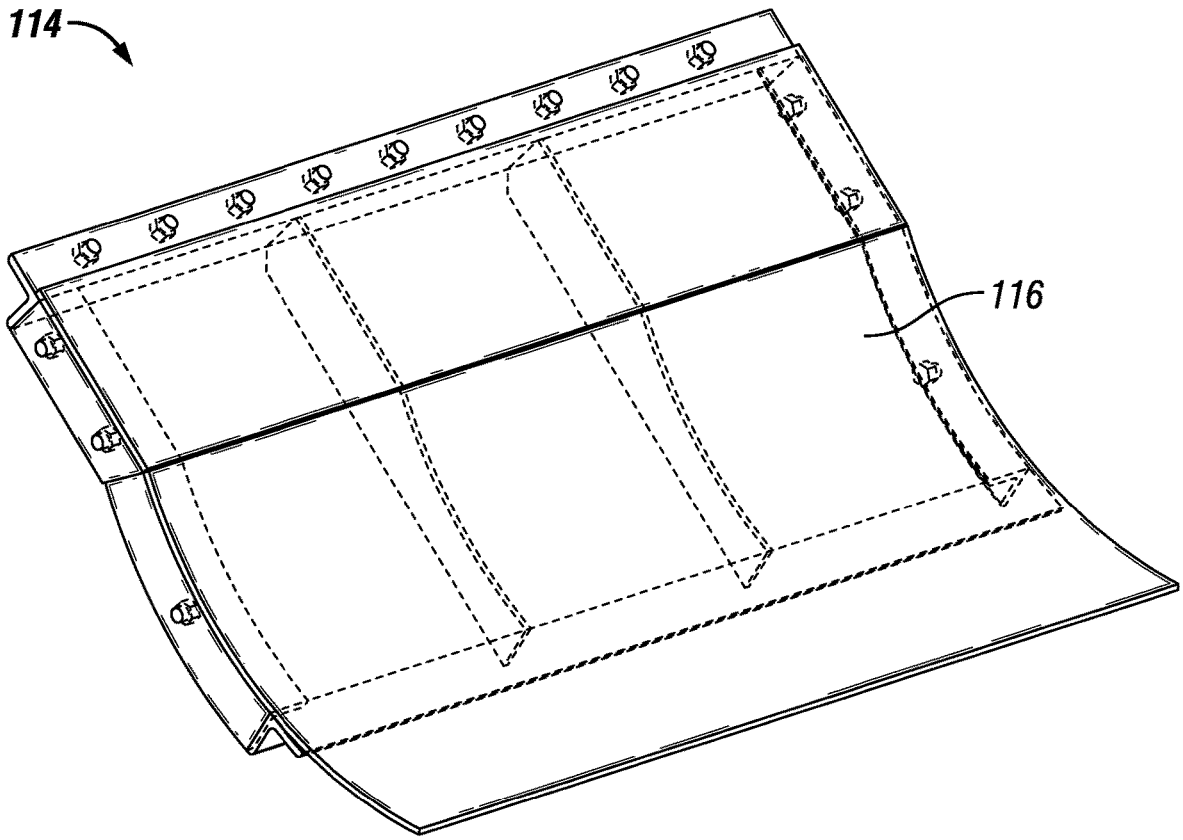
FIG. 15 is a perspective view of an inlet guide chute according to an embodiment of the present invention.
Figure 16:
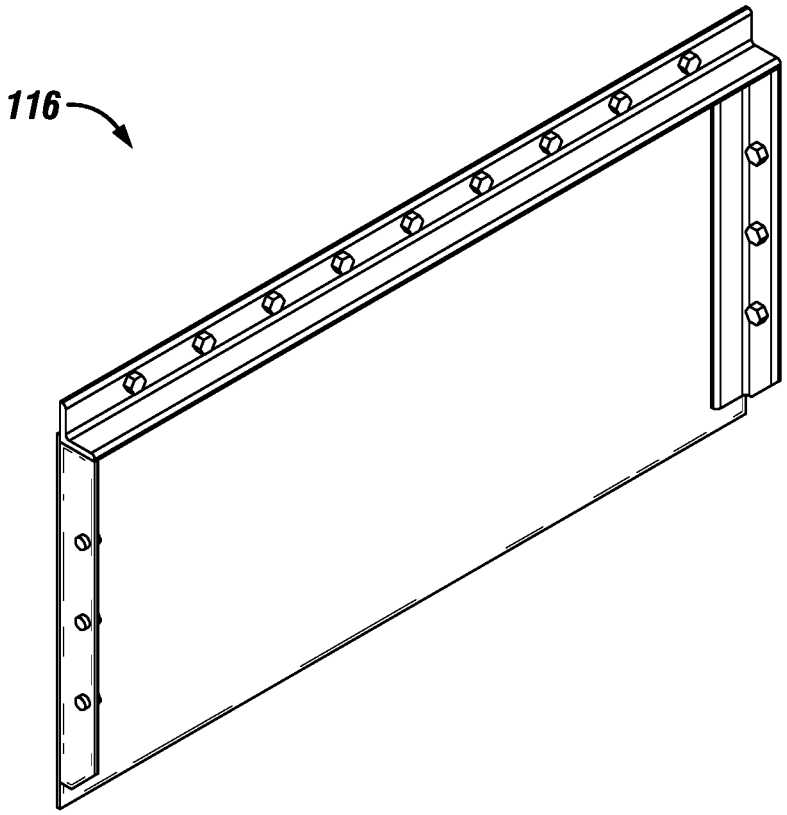
FIG. 16 is a perspective view of an outlet guide chute according to an embodiment of the present invention.

FIG. 15 depicts an inlet guide chute 114, configured for positioning at the inlet end of the housing 12, and to help guide the feedstock 118 that drops through the inlet 14 onto the plate 18 as necessary. In the embodiment shown, the lower portion 116 of the inlet guide chute 114 has a unique concave shape, which may help to guide the feedstock 118 more gradually onto the plate 18, and which accommodates the movement of paddles 22 past the inlet guide chute 114 as the conveyor turns. Similarly, FIG. 16 depicts an outlet guide chute 118, configured to be positioned at the outlet end of the housing 12, to help guide the feedstock 118 from the plate 18 through the outlet 16 of the distillation chamber 13.

Figure 17:
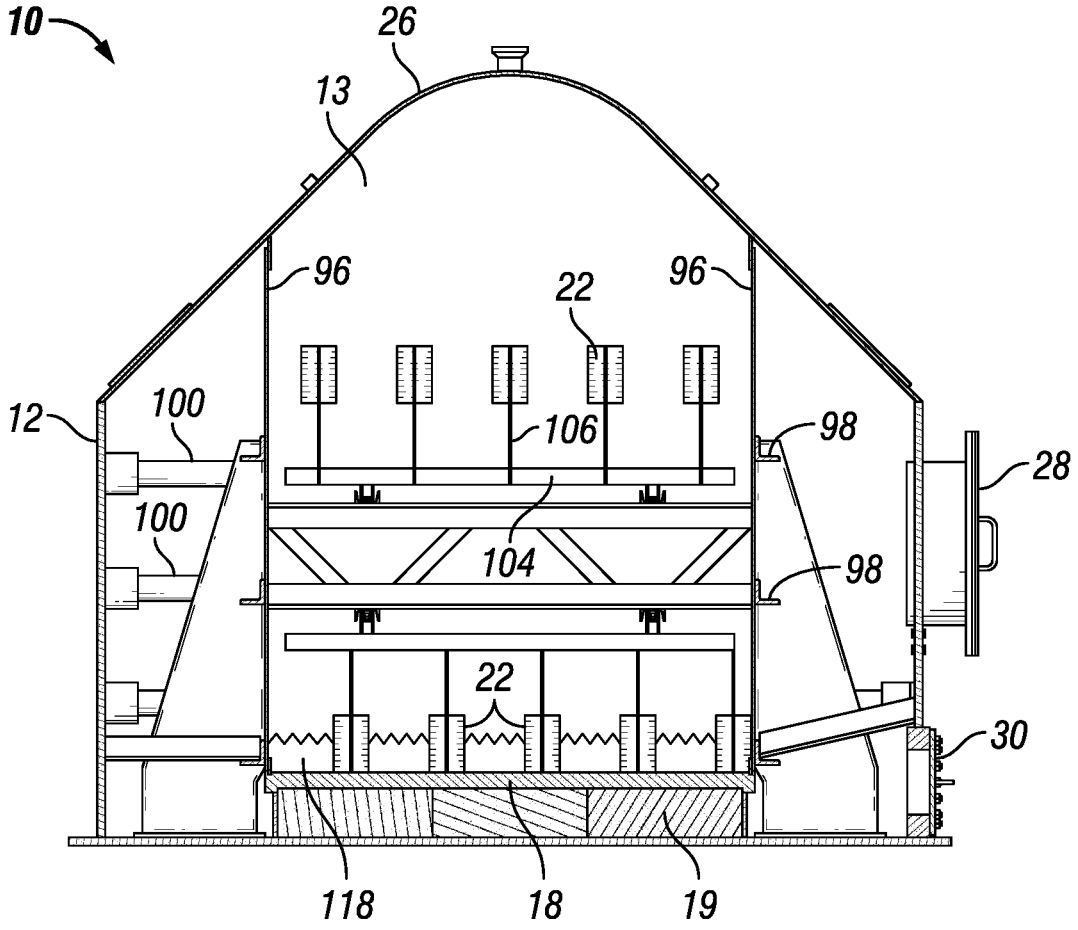
FIG. 17 is a front cross-sectional view of the distillation unit shown in FIG. 1, taken along line 17-17.

FIG. 17 depicts the distillation unit 10, including the paddles 22, plate 18, insulation grid assembly 19, and bulkhead assembly 94, all confined within housing 12. Also shown in FIG. 17 is the feedstock 118, positioned on the plate 18 as the paddles move through and agitate the feedstock 118.

In practice, the purpose of the distillation unit 10 is to provide a chamber wherein feedstock 118 is subjected to a destructive distillation process. As discussed above, according to such a process, the feedstock is heated in the absence of oxygen as the feedstock is moved through the distillation chamber 13, leading to cracking of the feedstock, and the production of useful products. Initially, feedstock 118 is introduced to the distillation chamber 13 via the inlet chute 24. The feedstock 118 can be provided to the inlet chute 24 from an infeed hopper, and may pass through a meter attached to the inlet chute 24. Inside the distillation chamber 13, the feedstock 118 contacts a plate 18 that may be heated by inserting elongate heating rods 41 into transverse heating apertures 38 in the plates 18. The elongate heating rods 41 may be heated by any appropriate means, such as, for example, by electricity.

Once the feedstock 118 is in position on the plate 18, the feedstock is agitated by the paddles 22, which are driven by the conveyor 20. The paddles 22 can be staggered, and specially shaped, as discussed above, to maximize agitation of the feedstock 118, driving the feedstock 118 forward, but also laterally and upwardly to circulate the feedstock 118. Once the feedstock 118 has been driven by the paddles 22 across the length of the plate 18, it is discharged through the outlet 16 of the distillation chamber 13.

As the feedstock 118 is heated and agitated, as described herein, gases are produced within the distillation chamber 13. The shape of the housing 12 can include a domed or peaked upper portion 26 of the housing, which can help to mix the gases to create useful products.

The invention shown and described herein is capable of converting raw coal and/or biomass, and producing at least three marketable products, including a cleaner, higher energy coal product, a liquid hydrocarbon/chemical feedstock, and a low energy gas stream. In turn, these products can be used to create many additional useful products, such as, for example, cosmetics, pharmaceuticals, plastics, cleaner fuels, etc.

The invention has been sufficiently described so that a person with average knowledge in the matter may reproduce and obtain the results mentioned in the invention herein Nonetheless, any skilled person in the field of technique, subject of the invention herein, may carry out modifications not described in the request herein, to apply these modifications to a determined structure, or in the manufacturing process of the same, requires the claimed matter in the following claims; such structures shall be covered within the scope of the invention.

It should be noted and understood that there can be improvements and modifications made of the present invention described in detail above without departing from the spirit or scope of the invention as set forth in the accompanying claims.

What is claimed is:

1. A method of processing feedstock in a distillation device, the method comprising:

a) introducing feedstock into a distillation chamber so that the feedstock rests on a substantially horizontal plate in the distillation chamber, wherein the plate includes transverse heating apertures extending transversely across the full width of the plate from a first end to a second end;

b) inserting elongate heating rods into the transverse heating apertures in the plate, wherein the elongate heating rods extend across the full width of the plate from the first end to the second end;

c) heating the elongate heating rods, so that the elongate heating rods transfer heat to the plate, which in turn transfers heat to the feedstock;

d) agitating the feedstock by driving paddles through the feedstock to move the feedstock laterally, as well as forward and vertically upward; and e) discharging the feedstock from the distillation chamber.

2. The method of claim 1, further comprising:

arranging the paddles in rows, the lateral position of the paddles of each row varied from that of the paddles in an adjacent row, to increase the lateral and forward movement of the feedstock as the feedstock is agitated.

3. The method of claim 1, further comprising:

orienting the paddles so that as they pass through the feedstock, they move the feedstock vertically upward so that the feedstock is constantly circulated from a position adjacent the plate to a position removed from the plate.

4. The method of claim 1, further comprising:

mixing gases within the distillation chamber prior to venting the gases from the chamber.

5. The method of claim 1, wherein step a) further comprises:

electrically heating the elongate heating rods.

6. The method of claim 1, wherein the plate comprises a plurality of plate sections.

7. The method of claim 1, further comprising inserting a plurality of thermocouples into the transverse heating apertures of the plate to measure temperature of the plate.

* * * * *